United States Patent [19]

Standiford

[11] 4,108,069

[45] Aug. 22, 1978

[54] ON-PRESS PRINTING PLATE LOCKING SYSTEM

[76] Inventor: Fred W. Standiford, 22577 Margarita Dr., Woodland Hills, Calif. 91364

[21] Appl. No.: 342,186

[22] Filed: Mar. 16, 1973

Related U.S. Application Data

[63] Continuation-in-part of Ser. No. 130,090, Apr. 1, 1971.

[51] Int. Cl.[2] ..... B41F 27/12

[52] U.S. Cl. ..... 101/415.1

[58] Field of Search ..... 101/415.1, 378

[56] References Cited

U.S. PATENT DOCUMENTS

| | | | |
|---|---|---|---|
| 2,137,851 | 11/1938 | Nelson et al. | 101/415.1 |
| 2,201,474 | 5/1940 | Carlson | 101/415.1 X |
| 2,706,947 | 4/1955 | Albrecht | 101/415.1 |
| 3,218,970 | 11/1965 | Heimlicher et al. | 101/415.1 X |
| 3,696,744 | 10/1972 | Etchell | 101/415.1 |

*Primary Examiner*—Robert E. Pulfrey
*Assistant Examiner*—Edward M. Coven
*Attorney, Agent, or Firm*—Trask & Britt

[57] ABSTRACT

A system for locking thin flexible printing plates on to rotary printing press saddles includes securing means positioned along a first longitudinal side edge of such a saddle and a support member rotatably journaled along a second longitudinal side edge of the saddle and biased longitudinally away from the first transverse side. Pins are secured to the support member to register with corresponding openings in such a flexible printing plate. A rotation tool with openings formed along an edge to coact with said register pins is operable to rotate the support member to secure such a flexible printing plate. A locking means is provided to prevent support member rotation when such a flexible printing plate is secured to such a saddle.

7 Claims, 7 Drawing Figures

ON-PRESS PRINTING PLATE LOCKING SYSTEM

RELATED APPLICATIONS

This application is a continuation-in-part of copending, commonly assigned application Ser. No. 130,090, filed Apr. 1, 1971 for "Clamping Saddles for Thin Flexible Printing Plates," the disclosure of which is hereby incorporated by reference.

BACKGROUND OF THE INVENTION

1. Field

This invention relates to rotary printing press saddles. Specifically, it provides a system for securing thin flexible printing plates to rotary printing press saddles. The system permits installation and removal of such plates without requiring the removal of the saddle from a saddle press.

2. State of the Art

It is common practice today to use a printing press saddle to secure a thin flexible printing plate to the rotating drum (cylinder) of a rotary printing press. The saddles may take a variety of shapes and forms, but are typically semicylindrical in shape and adapted to be removably secured to the drum. A number of different techniques and devices are available to effectively secure a saddle to the cylinder of a press. U.S. Pat. No. 3,537,395 discloses such a representative method.

A variety of devices or methods are also available to secure a thin flexible printing plate to a saddle. Representative of such devices are those disclosed in U.S. Pat. Nos. 3,537,395 (Prince); 2,937,593 (Ritzerfeld); 2,512,940 (Janke); and 2,137,851 (Nelson, et al.). The aforementioned Ser. No. 130,090, also discloses a device for securing a thin flexible printing plate to a saddle.

The devices and methods of the prior art have certain shortcomings. They generally do not permit rapid and efficient installation and removal of thin flexible printing plates because the saddle must first be removed from the cylinder of the press and/or because their plate-securing mechanisms are difficult to operate. In some cases (e.g., Nelson, et al.), an entire segment of the press drum must be removed. Moreover, many of the devices fail to assure proper alignment of the flexible plate on the saddle so that unnecessary operator time must be expended to effect proper adjustment and alignment. Further, many of the devices cannot accommodate slight dimensional variances between plates. Thus, a plate may be not as tightly secured to the saddle as desired; or it may not fit at all.

The present invention permits the operator rapidly and efficiently to obtain proper plate alignment notwithstanding slight dimensional variances between plates. Installation and removal of the printing plates may also be accomplished simply and reliably with the saddle attached to the press cylinder (drum). Thus, efficiency in operation and economies of time in printing press operations may be obtained by use of this invention.

SUMMARY OF THE INVENTION

The present invention provides an on-press locking system for securing thin flexible printing plates to a semi-cylindrical saddle adapted to be secured to the cylinder of a rotary printing press. The locking system includes securing means structurally associated with a first longitudinal side edge of a saddle and a rotatable support member structurally associated with a second longitudinal side edge of a saddle with means attached thereto for engaging an edge of a flexible printing plate. Also included are locking means associated with the support member to secure it in a predetermined rotational position, means for rotating the support member, and means for selectively operating the locking means.

The securing means is desirably attached to and positioned along the first longitudinal side edge of the saddle for securing a first side edge of the flexible printing plate. The support member is journaled to and positioned along the second longitudinal side edge, which is opposite the first longitudinal side edge of the saddle, and is rotatable on an axis approximately parallel to the second longitudinal edge of the saddle. The register pins are positioned on the support member to coact with register pin openings formed along a second side edge of the flexible printing plate. The locking means preferably comprises a latching device which is positioned inside the saddle plate structure to act against the support member and is capable of external operation. A rotation tool may also be provided to rotate the support member. Such a tool may, for example, have pin openings to register with the register pins attached to the support member and means for applying torque to the support member through the pins. The rotation tool may also be provided with means to selectively operate the latching device.

In operation, the first side edge of the flexible printing plate is secured to the saddle at the first longitudinal side edge of the saddle by the securing means. The support member is rotated so that the register pins are oriented to permit installation of the flexible printing plate; e.g., projecting outward from saddle and cylinder. The register pin openings along the unsecured edge (second side edge) of the printing plate are then placed over the pins. The rotation tool is then fitted over the plate and the register pins of the support member, and the support member is in turn rotated to secure the plate tightly to the surface of the saddle; e.g., with the register pins oriented down (toward the outside face of the press cylinder). Upon reaching the secured position, the locking means operates to lock the support member and thus the flexible printing plate in place. The reverse operation is performed to remove the flexible printing plate from the saddle.

In a preferred embodiment of the invention, the locking means is at least one spring-loaded slug mounted in the saddle to coact with a notch in an elongated, cylindrically shaped support member. The notch is positioned in the support member to register with the spring-loaded slug when the support member has been positioned in a predetermined orientation; e.g., with the register pins down. The support member is rotatably journaled to the saddle by journal means located at the opposite ends of the support member. The bearing surface of the journal means is elongated in a plane substantially conforming to a plane containing the center line of the spring-loaded slug and the axis of the support member in order to permit slight movement of the support member in that plane. Thus, the spring-loaded slug may exert additional tightening force on the flexible printing plate through the support member.

Unlatching, for removal of the flexible printing plate may be effected by forcing the slug out of the notch, for example, by inserting a pin through the support member. Preferably, such a pin is included on the rotation tool; and the plate and support member are provided with holes registering with the latch notch to permit entry of the pin. Insertion and unlatching is thus effected automatically and simultaneously with forced placement of the tool over the register pins in preparation for rotating the support member.

BRIEF DESCRIPTION OF THE DRAWINGS

In the drawings, which illustrate what is presently regarded as the best mode for practicing the invention.

DESCRIPTION OF THE ILLUSTRATED EMBODIMENT

Figure 1:
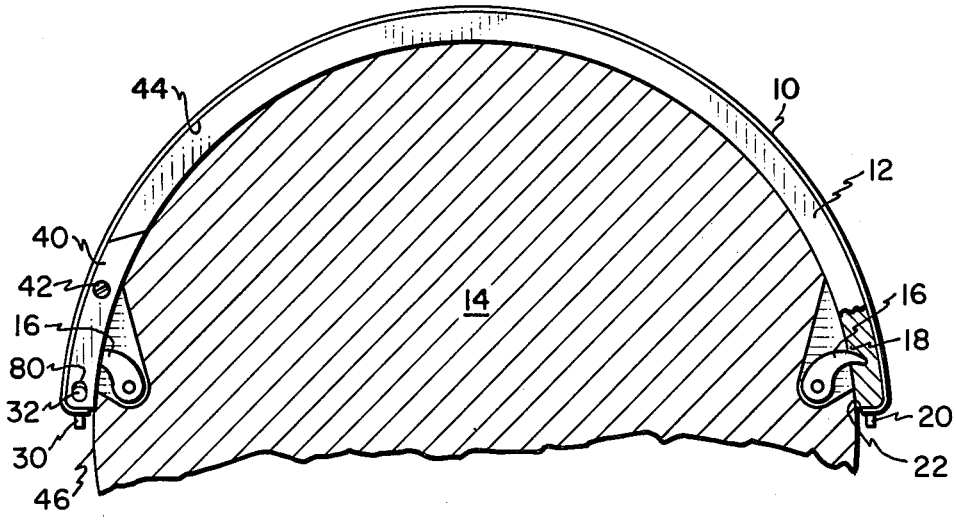
FIG. 1 is a cross-sectional end view, partially broken away, of a cylinder of a rotary printing press with a saddle of the invention having a flexible printing plate mounted thereon.

As shown by FIG. 1, a thin flexible printing plate 10 is mounted on a semicylindrically shaped, substantially rigid rotary printing press saddle 12. The saddle 12 is removably secured to the cylinder (drum) 14 of the press by a pawl finger 16 and groove 18 system. The pawl fingers 16 are secured to the cylinder 14 and tensionally secure the saddle 12 by extending into grooves 18.

Figure 2:
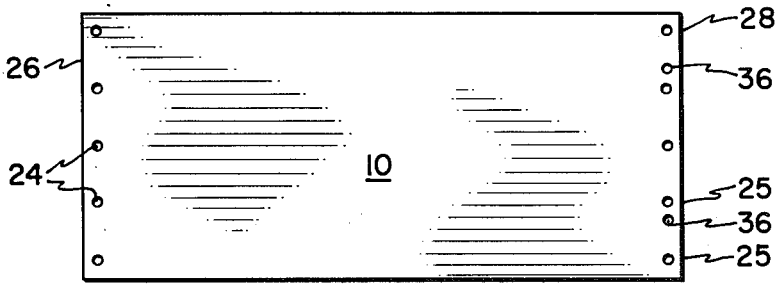
FIG. 2 is plan elevation view of a flexible printing plate adapted for use with this invention.

As illustrated in FIG. 1, a plurality of register pins 20 are positioned along the first longitudinal side edge 22 of saddle 12. (The word longitudinal, as used herein, refers to a direction substantially parallel to the axis of the cylinder). Register pin openings 24 (FIG. 2) are formed in plate 10 along its first side edge 26, each sized to receive a register pin 20. Additional register pin openings 25 are similarly formed along a second side edge 28 of plate 10 (FIG. 2) to register with pins 30 extending from the support member 32 which is positioned along the second longitudinal side edge 34 (FIG. 5) of the saddle 12, as hereinafter more fully discussed. Unlatching pin holes 36 are also formed along the second side edge 28 of plate 10 to permit rotation tool 38 (FIG. 5) operation, as more fully explained hereinafter.

Figure 3:
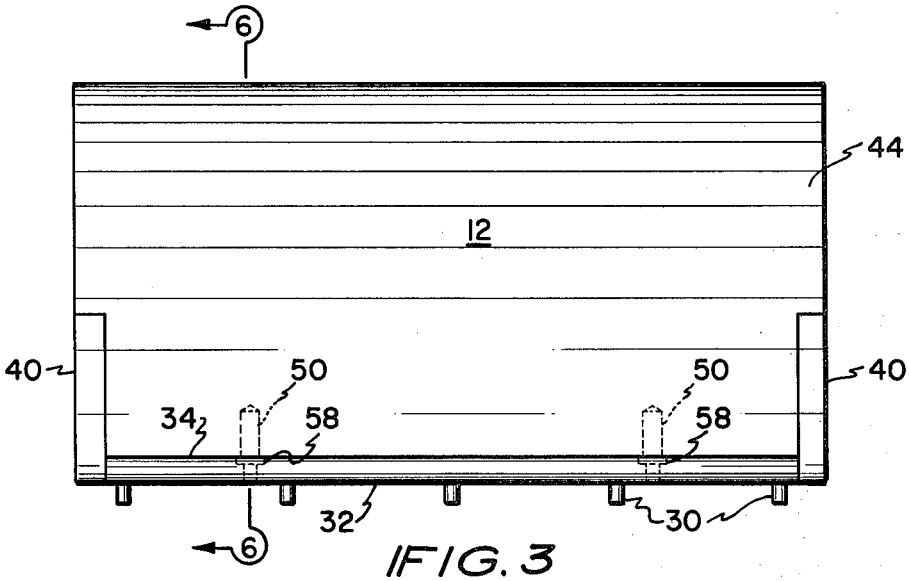
FIG. 3 is a front view of a saddle illustrating an embodiment of the on-press locking system of this invention.
Figure 5:
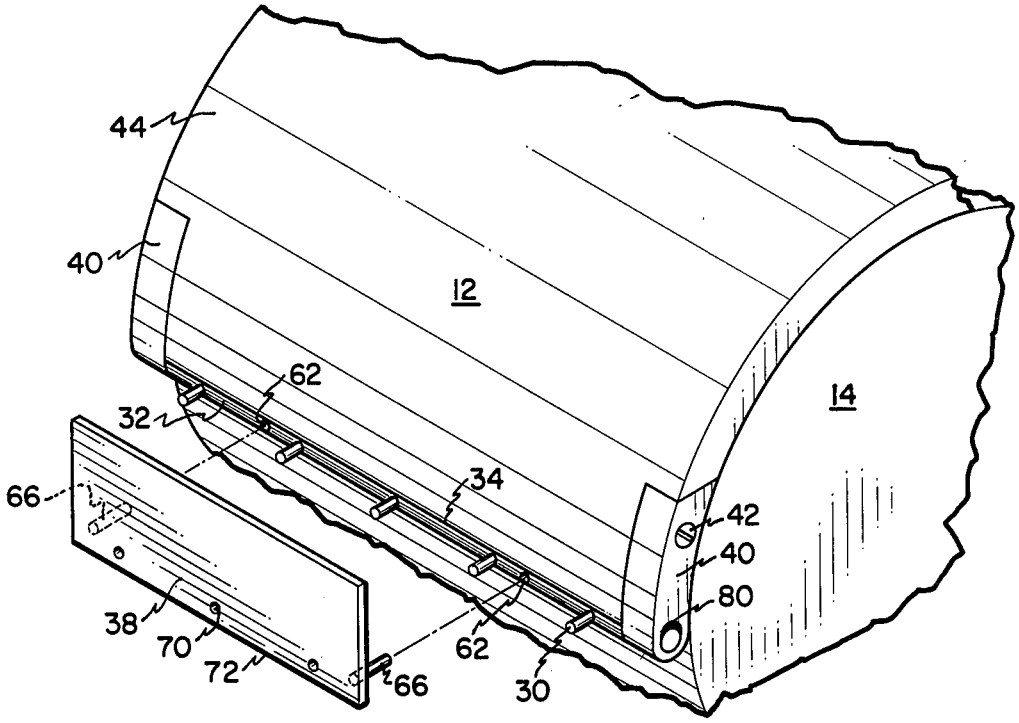
FIG. 5 is a partial view in perspective of the system of FIG. 3, shown in unlatched condition.
Figure 4:
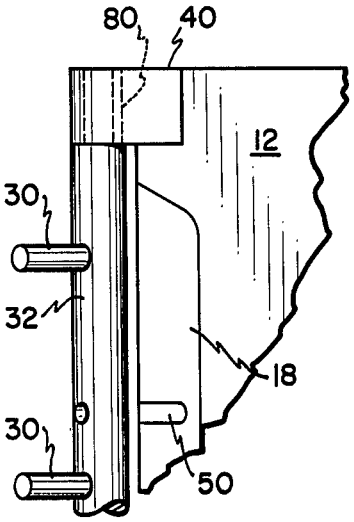
FIG. 4 is a partial bottom view of the system of FIG. 3.

As best shown in FIGS. 3–5, a support member 32 is positioned and rotatably mounted along the second longitudinal side edge 34 of saddle 12 by journaling the bar 32, preferably proximate its opposite ends, in journal means (support brackets) 40. The journal means 40 is fixedly secured to the saddle 12 in conventional fashion, for example, with screws 42 threaded into the structure of saddle 12. A plurality of register pins 30 are fixedly secured to support member 32 to register with pin openings 25 along second edge 28 in printing plate 10.

The support member 32 is preferably a solid cylindrical metal bar. It is capable of rotation so that pins 30 may be positioned in a flexible printing plate-loading and unloading (installation and removal) position. In that position, the pins 30 extend out and away from the outside face 44 of saddle 12 and the outside surface 46 of cylinder 14 (FIG. 5). The support bar 32 also may be positioned in the plate-secured position. In this position, the pins 30 extend tangential to the outside face 44 of saddle 12 and the outside surface 46 of cylinder 14 (FIG. 1).

Figure 7:
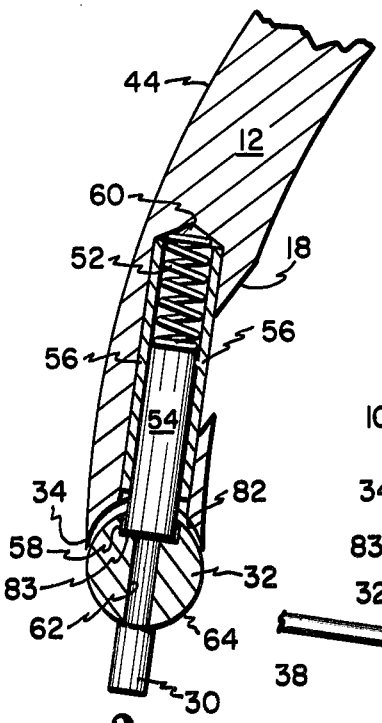
FIG. 7 is a cross-sectional view similar to FIG. 3 but showing the latching device being unlatched.
Figure 7:
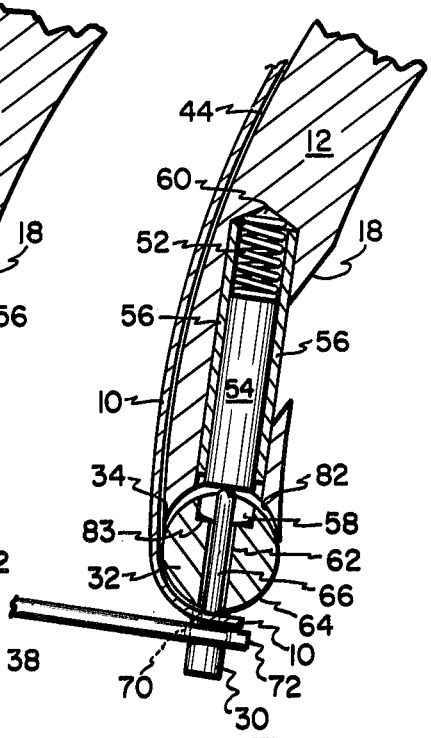
Figure 6:
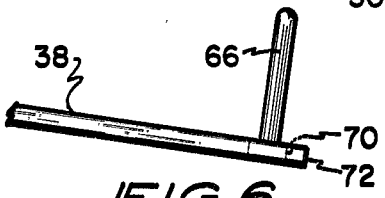
FIG. 6 is a cross sectional view of the system of FIG. 3 looking in the direction of the arrows along the line 6—6 and showing a latching device of the invention in latched condition.

Locking means for locking the support bar 32 in the plate-secured position, as best illustrated in FIGS. 3, 6 and 7, includes two latching devices 50. Plural devices 50 are preferred to obtain improved locking reliability without unnecessary component duplication. The latching devices 50 include a spring 52 which is compressed by slug 54, both being contained in a housing 56. In the plate-secured position, the slug 54 is forced by spring 52 into a notch 58 formed in the support member 32. The notch 58 is of sufficient depth (e.g., about $\frac{1}{8}$ inch) to permit secure latching. The slug 54 and notch 58 are preferably of circular cross section. The notch 58 has a slightly larger (e.g., about 1/64 inch) diameter to avoid slug 54 jamming in the notch 58. The latching device 50 is fixedly secured in a hole 60 bored into the saddle plate 12 structure substantially normal to second longitudinal edge 34. It may be secured in hole 60 by friction fit, retaining ring (not shown) or other conventional means as convenient.

An unlatching hole 62 is located in the support member 32, passing from the inside of notch 52 to the outside surface 64 of support bar 32 opposite said notch 58. The centerline of the unlatching hole 62 substantially conforms to a plane containing the center line of latching device 50 and the centerline of support bar 32. As shown, the unlatching hole 62 is circular to accept a rounded unlatching pin 66 attached to the rotation tool 38, as is more fully described below. The diameter of hole 62 is smaller than the diameter of notch 58 and slug 54 so that the slug 54 cannot be forced into the unlatching hole 62.

As best seen in FIGS. 5 and 7, a rotation tool 38 is provided to rotate the support member 32 between the plate-secured position and plate-loading and unloading position. The rotation tool 38 (FIG. 5) is provided with register pin openings 70 positioned along edge 72 equal to the number of register pins 30 encompassed between the two unlatching pin holes 62. As shown, the tool 38 is equipped with two unlatching pins 66 fixedly secured thereto and positioned to operate their respective latching devices 50 through unlatching pin holes 62 in support bar 32 and unlatching pin holes 36 in flexible printing plate 10 (not shown in FIG. 5). The unlatching tool 38 is preferably a thin rectangular metal plate which is of sufficient dimension to permit ease in operation while having adequate structural strength (e.g., about $2 \times 8\frac{1}{4} \times 3/16$ inches). The simplicity of tool 38 generates cost savings in its manufacture and production.

Referring specifically to FIG. 7, a rotation tool 38 equipped with an unlatching pin 66 is shown unlatching the latching device 50. As can be seen from the illustration, the pin 66 is of sufficient length to contact and completely displace the slug 54. With the application of force via the tool 38 and the pin 66, the slug 54 is displaced back against spring 52 and out of notch 58. The tip of pin 66 is beveled to facilitate support bar 32 rotation after unlatching.

Provision for additional tightening and securing forces for plate 10, other than those derived by rotation of support bar 32, is yet another feature of this embodiment. Slight support bar 32 movement (e.g., about 3/16 inch) is permitted in a plane substantially parallel to the plane containing the axis of the support bar 32 and the centerline of latching device 50. The journal means 40 bearing surface 80 (FIGS. 1, 4 and 5) supporting and retaining support bar 32 is elongated in a plane substantially conforming to the plane described next above. Similar elongation is provided in the semicircular groove 82 (FIGS. 6 and 7) in the saddle 12 structure which is provided for adaptation of support bar 32 to longitudinal edge 34. The additional tightening force is provided by the spring 52 of latching device 50 as it is applied 32 through slug 54. When the support bar 32 is in the printing plate-loading and unloading position, the spring 52 through slug 54, which is in contact with the outside surface 64 or bar 32, forces the bar 32 away from saddle 12 structure to the extent permitted by the bearing surface 80 of journal 40. When the support bar 32 is in the plate-secured position, the spring 52 through slug 54, which is in contact with the inside surface 32 of notch 58, similarly forces the bar 32 away from saddle 12 structure to the extent permitted by the bearing surface 80 of journal 40. Thus the support bar 32 assumes a position within the limitations of the journal 40 bearing surface 80 dictated by the dimensional characteristics of plate 10. Therefore, slight variances in printing plate dimensions are accommodated while simultaneously applying the additional plate-tightening and securing force produced by spring 52 as transmitted through slug 54 to support bar 32. Additional springs (not shown) may be installed to provide additional force against the bar 32 if it is desired to impart greater tension to the thin plate 10. An additional advantage of the above-described feature is that the costs of component manufacturing may be reduced. The accuracy standards of component machining (e.g., the bearing surface 80) are lower, thus permitting economies of time in manufacturing with concomitant cost reduction.

In operation, the first edge 20 of a thin flexible printing plate 10 is secured to the first longitudinal side edge 22 of saddle 12 as illustrated in FIG. 1 or by other securing means. With support bar 32 in the plate-loading and unloading position (illustrated in FIG. 5), the plate 10 is conformed to the outside face 44 of saddle 12. The register pin openings 26 are in turn fitted onto register pins 30. Rotation tool 38 is then applied with unlatching pins 66 being inserted through unlatching pin holes 36 in plate 10 and through unlatching pin holes 62 in support bar 32. Register pins 30 simultaneously pass through holes 70 in tool 38. The rotation tool 38 is then rotated until the support bar 32 is in the latched position (illustrated in FIGS. 1 and 6). The tool 38 is then removed, and printing operations undertaken as desired.

To remove the thin flexible printing plate 10, rotation tool 38 is applied as above and as illustrated in FIG. 7. With the application of sufficient force to displace slug 54 through tool 38, the tool 38 may then be operated to rotate support bar 32 to the plate installation and removal position. Subsequent installation and removal operations may be effected as described above. It should also be noted that operation as above-described may be accomplished with the saddle 12 attached to cylinder 14 or removed from the cylinder 14 as desired by the operator.

It is to be understood that the embodiments of the invention above-described are merely illustrative of the application of the principles of this invention. Reference herein to details of the illustrated embodiment is not intended to limit the scope of the claims which themselves recite those features regarded as essential to the invention.

I claim:

1. An on-press flexible printing plate locking system for printing press saddles which are semicylindrical in shape and have first and second opposite longitudinal side edges which are substantially parallel to the axis of the cylinder of a rotary printing press and are adapted to be secured to the outside surface of said cylinder, and which are capable of supporting a thin flexible printing plate on the outside face of said saddle, said locking system comprising:

securing means attached to and positioned along said first longitudinal side edge of said saddle for securing a first side edge of said thin flexible printing plate to said saddle while said saddle is attached to said cylinder of said press;

a support member journaled to and positioned along said second longitudinal side edge of said saddle by journal means;

a plurality of outwardly extending register pins secured to said support member and positioned to register with pin openings formed along a second side edge opposite said first side edge of said flexible printing-plate;

locking means for locking said support member in a printing-plate-secured position in which said thin flexible printing plate is secured to said saddle, said locking means being comprised of a spring loaded slug located internally in the structure of said saddle and at least one notch formed in said support member to be opposite said spring loaded slug when said support member is in said printing-plate-secured position, said notch substantially conforming to the cross-sectional dimensions of said slug and shaped to receive a portion of said slug so that when said support member is rotated to said printing-plate-secured position said slug is urged by said spring into said notch;

rotation tool means which is mechanically applied to said support member to impart rotational torque to said support member to secure said flexible printing plate to said saddle with said saddle attached to said cylinder, said rotation tool means having at least one edge with pin openings formed therealong which register with said register pins secured to said support member when said rotation tool is mechanically applied to said support member so that rotational torque may be imparted to said support member via said pins;

an unlatching pin hole which is smaller in cross section than said notch and which extends from said notch through the center of said support member to the surface of said support member opposite said notch; and an unlatching pin substantially conforming to the dimensions of said unlatching pin hole and positioned along said edge of said rotation tool means to coact with said unlatching pin hole to allow said slug to be forced out of said notch upon application of said tool means to said support member for removing said thin flexible printing plate.

2. The locking system of claim 1, wherein said support member is a cylindrically shaped elongated bar, and wherein the support bar bearing surface of said journal means is elongated in a plane substantially conforming to a plane containing the centerline of said latching device and the axis of said support member, said support member being capable of slight movement in said plane of elongation.

3. In combination, a thin flexible printing plate having first and second opposite side edges, and an on-press flexible printing plate locking system for printing press saddles, said saddles being semicylindrical in shape, having first and second longitudinal side edges which are substantially parallel to the axis of the cylinder of a rotary printing press and adapted to be secured to the outside surface of said cylinder, and being capable of supporting said thin flexible printing plate on the outside face of said saddle, said locking system comprising:

securing means attached to and positioned along said first longitudinal side edge of said saddle for securing said first side edge of said thin flexible printing plate to said saddle while said saddle is attached to said cylinder of said press;

a support member journaled to and positioned along said second longitudinal side edge of said saddle by journal means;

a plurality of outwardly extending register pins secured to said support member and positioned to coact with register pin openings formed along a second side edge opposite said first side edge of said flexible printing plate;

locking means for locking said support member in a printing-plate-secured position in which said thin flexible printing-plate is secured to said saddle, said locking means being comprised of a spring loaded slug located internally in the structure of said saddle and at least one notch formed in said support member to be opposite said spring loaded slug when said support member is in said printing-plate-secured position, said notch substantially conforming to the cross-sectional dimensions of said slug and shaped to receive a portion of said slug so that when said support member is rotated to said printing-plate-secured position said slug is urged by said spring into said notch;

rotation tool means which is mechanically applied to said support member to impart rotational torque to said support member to secure said flexible printing plate to said saddle with said saddle attached to said cylinder, said rotation tool means having at least one edge with pin openings formed therealong to register with said register pins secured to said support member when said rotation tool is mechanically applied to said support member so that rotational torque may be imparted to said support member via said pins;

an unlatching pin hole which is smaller in cross section than said notch and which extends from said notch through the center of said support member to the outside of said support member opposite said notch; and an unlatching pin substantially conforming to the dimensions of said unlatching pin hole, and positioned along said edge of said rotation tool means to coact with said unlatching pin hole to allow said slug to be forced out of said notch upon application of said tool means to said support member for removing said thin flexible printing plate.

4. The combination of claim 3, wherein said support member is a cylindrically shaped elongated bar, and wherein the support bar bearing surface of said journal means is elongated in a plane substantially conforming to a plane containing the centerline of said latching device and the axis of said support member, said support member being capable of slight movement in said plane of elongation.

5. A saddle lock-up for flexible printing plates comprising:

(a) semi-cylindrical saddle means having a leading edge and a trailing edge and adapted to be locked to a printing press cylinder;

(b) a bar slideably connected to said trailing edge to move toward and away from said trailing edge in a generally circumferential direction, said bar being rotatable about its longitudinal axis between a non-printing position for mounting a flexible plate and a printing position, said bar having a first securing means for holding one end of a flexible printing plate;

(c) a second securing means connected to said leading edge to secure the other end of a flexible printing plate;

(d) releasable locking means interlocking said trailing edge and said bar against rotation in the printing position; and (e) resilient means interposed between said bar and said trailing edge, said resilient means being compressed when said bar is rotated to the printing position to bias said bar away from said trailing edge and thereby uniformly tension a flexible printing plate.

6. A device as in claim 5 wherein said locking means includes a spring biased pin in said trailing edge and a complementary opening through said bar said pin being positioned in said opening in the printing position.

7. A device as in claim 6 wherein said first and second securing means comprise pins over which a flexible printing plate may be impaled.

* * * * *